United States Patent [19]

Binstock et al.

[11] Patent Number: 4,976,108

[45] Date of Patent: Dec. 11, 1990

[54] TURBINE EFFICIENT VALVE POSITION COMPUTER

[75] Inventors: Morton H. Binstock, Pittsburgh; Walter B. Shaltes, Saxonburg, both of Pa.

[73] Assignee: Westinghouse Electric Corp., Pittsburgh, Pa.

[21] Appl. No.: 521,869

[22] Filed: May 11, 1990

[51] Int. Cl.[5] ..... F01K 13/02

[52] U.S. Cl. ..... 60/660; 60/667

[58] Field of Search ..... 60/660, 664, 665, 667

[56] References Cited

U.S. PATENT DOCUMENTS 4,474,012 10/1984 Chamberlain ..... 60/660

4,577,281 3/1986 Bukowski et al. ..... 60/660 XR

*Primary Examiner*—Allen M. Ostrager

[57] ABSTRACT

A method and apparatus for controlling the operation of a steam turbine system, which system includes a source of steam under a controllable pressure, a plurality of governor valves connected between the source and the turbine first stage, each governor valve being movable between two selected positions each creating minimum steam flow throttling losses, a system control device (2) for producing a system control signal representative of the desired power level to be supplied by the turbine system, and a governor valve control (8) connected for producing a valve control signal in response to an input signal and for positioning each governor valve in accordance with the value of the valve control signal. During operation, the input signal to the governor valve control (8) is given a value which is based on the system control signal and which causes the valve control signal to have a value which will place each governor valve at least approximately at a selected position. In order to position the governor valves more accurately, the rate of flow of steam from the steam source is measured (18); the difference between the measured rate of flow and the expected rate of flow of steam from the steam source is determined (20, 24); and the value of the input signal to the governor valve control is modified (6, 12) in response to the difference determined in a direction to vary the positions of the governor valves in a manner to reduce the magnitude of that difference.

8 Claims, 1 Drawing Sheet

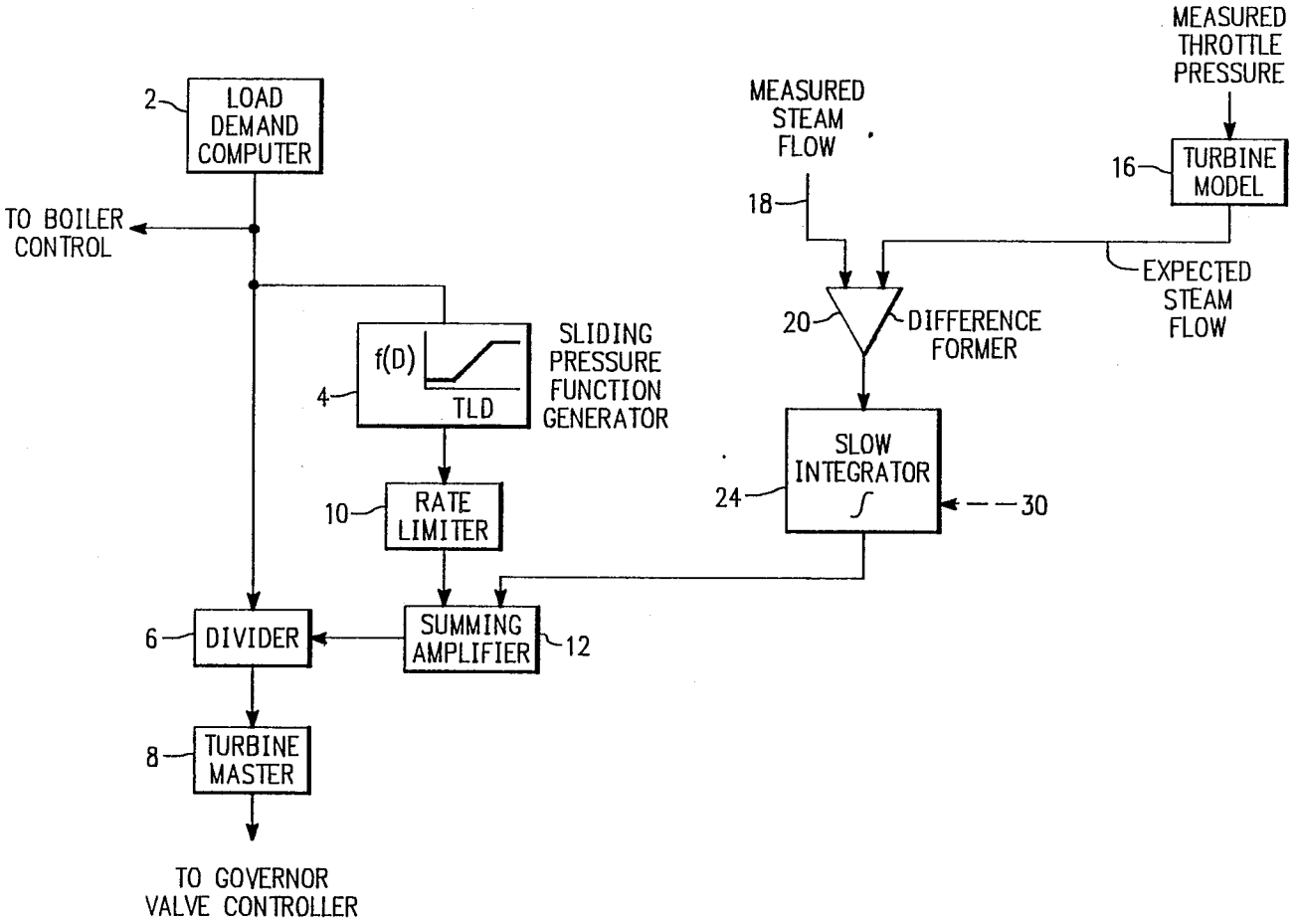
MEASURED THROTTLE PRESSURE
TURBINE MODEL
16
EXPECTED STEAM FLOW
MEASURED STEAM FLOW
18
DIFFERENCE FORMER
20
SLOW INTEGRATOR
24
30
SLIDING PRESSURE FUNCTION GENERATOR
f(D)
TLD
4
RATE LIMITER
10
SUMMING AMPLIFIER
12
LOAD DEMAND COMPUTER
2
TO BOILER CONTROL
DIVIDER
6
TURBINE MASTER
8
TO GOVERNOR VALVE CONTROLLER

TURBINE EFFICIENT VALVE POSITION COMPUTER

BACKGROUND OF THE INVENTION

The present invention relates to the control of steam turbines, particularly with regard to positioning of the turbine governor valves.

In a steam turbine system, such as utilized in a power generating facility, the power supplied by a turbine is set in accordance with the load demand on the generator, and this setting is effected primarily by controlling the rate of steam flow to the turbine first stage. The rate of steam flow, in turn, is adjusted primarily by appropriate setting of the output pressure from a source of steam, such as a boiler, and appropriate positioning of governor valves via which steam is delivered from the source to the inlet nozzles of the turbine first stage. Such a first stage typically has a plurality of nozzles distributed around its circumference, and a separate governor valve is provided for supplying steam to each nozzle. Depending on the operating requirements of the particular turbine system, all valves can be controlled to operate in unison or in a certain sequence.

Each governor valve can operate between a fully closed state and a fully open state. It is generally desired that each governor valve be placed at one of two selected positions. One of these positions, known as the crack point, is close to the fully closed position, while the other position, commonly known as the knee point, permits nearly full flow through the valve. Operation of a governor valve at a position intermediate the crack point and the knee point is generally undesirable because it results in a pressure drop across the valve, and this has an adverse effect on the efficiency of the turbine and on the heat rate of the power plant.

It is generally considered to be advantageous to operate the turbine governor valves in what is known as the sequential valve mode in which individual valves or groups of valves open or close in sequence as load demand increases or decreases. Particularly when a plant is called upon to operate at less than full load, sequential valve mode operation enhances operating efficiency.

Sequential valve mode operation is characterized by a plurality of governor valve settings which are known as valve points. At each valve point, one or more governor valves are open to a point which permits substantially full steam flow, which is a position between the knee point and a fully open condition, while substantially no steam is flowing through the other governor valves, in that each of these other governor valves is at a position between its crack point and its fully closed state.

If the output pressure from the steam source were maintained constant, each valve point would correspond to a specific load demand level. In order to allow such a system to respond efficiently to load demand levels between those specific levels, it is known to employ the sliding pressuring method in which, for example, the speed of the feed pump supplying water to the steam source, such as a boiler, is reduced. This reduces the pressure throughout the system, starting at the pump outlet, through the boiler, the super heaters and, finally, the turbine stages.

Thus, in one mode of operation of a facility of the type hereunder consideration, response to a given load demand can be achieved by adjusting the boiler output pressure to a value between minimum and maximum permissible values, setting the governor valves to a valve point which is closest to that associated with the selected load demand level and then either increasing or decreasing the boiler output pressure to the value required to meet the selected load demand when the governor valves are set at the selected valve point. Such a technique is described, for example, in U.S. Pat. No. 4,178,762, which issued to Binstock, et al., on Dec. 18, 1979.

In order for a system of this type to operate at optimum efficiency, it is important that all of the governor valves be set to a position closely corresponding to a valve point. While this can be readily achieved in facilities equipped with modern and sophisticated digital controllers which directly monitor the position of each governor valve and create position adjustments on the basis of such monitoring results, many older or less sophisticated facilities are not equipped to monitor the governor valve positions and the addition of monitoring devices to provide valve position feedback signals can add considerably to the cost of modernizing such facilities. However, it is precisely these older and less sophisticated facilities in which the governor valve control system cannot reliably effect precise positioning of the governor valves.

SUMMARY OF THE INVENTION

It is an object of the present invention to improve the operating efficiency of facilities employing turbine generators without requiring the addition of governor valve position feedback devices.

Another object of the invention is to effect precise positioning of the governor valves of a turbine in an economical manner.

A further object of the invention is to control the positions of a set of governor valves in a manner which establishes a desired relation between steam source outlet pressure and steam flow rate into the turbine first stage.

The above and other objects are achieved, according to the invention, in a method and apparatus for controlling the operation of a steam turbine system, which system includes a source of steam under pressure, means for varying pressure of the steam being produced by the source, a throttle valve connected to conduct steam from the source, a steam turbine having a first stage, a plurality of governor valves connected between the throttle valve and the turbine first stage, each governor valve being movable between two selected positions each creating minimum steam flow throttling losses, system control means for producing a system control signal representative of the desired power level to be supplied by the turbine system, and governor valve control means connected for producing a valve control signal in response to an input signal and for positioning each governor valve in accordance with the value of the valve control signal, in which method and apparatus the input signal to the governor valve control means is given a value which is based on the system control signal and which causes the valve control signal to have a value which will place each governor valve at least approximately at a selected position, by: measuring the rate of flow of steam from the steam source; determining the difference between the measured rate of flow and the expected rate of flow of steam from the steam source; and modifying the value of the input signal to the governor valve control means in response to the difference determined in the determining step in a direction to vary the positions of the governor valves in a manner to reduce the magnitude of that difference.

BRIEF DESCRIPTION OF THE DRAWING

The sole FIGURE of the drawing is a schematic diagram of a governor valve control system incorporating a preferred embodiment of the present invention.

DESCRIPTION OF THE PREFERRED EMBODIMENTS

The FIGURE illustrates the control system for the governor valves in a power plant which includes a steam turbine connected to drive an electrical power generator. Reference will first be made to those parts of the illustrated system which belong to the prior art.

The operation of such a system is controlled by a load demand computer 2 which produces an output signal representative of the load demand to be satisfied. This signal is supplied to a known boiler control subsystem as well as to a sliding pressure function generator 4 and a signal magnitude divider 6.

For a given boiler output pressure, the output signal from computer 2 may have any one of a plurality of defined values, each of which corresponds to a respective valve point of the turbine governor valves, i.e., for each of those values, the corresponding load demand will be satisfied with the governor valves at a corresponding valve point and the boiler pressure at the given value. If, for a load demand level between two such defined values, it is desired to satisfy the indicated load demand while maintaining all of the governor valves at a valve point, the boiler output pressure must be varied, either upwardly or downwardly, i.e., the boiler output pressure must slide.

The output signal from computer 2 is supplied via divider 6 to a turbine master 8 which produces, in response to that signal, a control signal. The control signal is delivered to a governor valve controller that, in turn, places all of the governor valves in a configuration corresponding to the load demand signal from computer 2. If the load demand signal has one of the defined values referred to above, the signal from turbine master 8 will have a value corresponding to a valve point of the governor valves.

If the output signal from computer 2 has a value between two such defined values, then the signal from computer 2, by itself, would cause turbine master 8 to produce a signal which establishes governor valve positions which deviate from a valve point. This result is prevented by the operation of sliding pressure function generator 4, in conjunction with a rate limiter 10 and an amplifier 12 connected between rate limiter 10 and divider 6.

When the output signal from computer 2 has a value between two defined values, this is detected by generator 4, which produces an output signal representing the ratio of the value of the actual output signal produced by computer 2 to the value of that defined computer output signal which is closest to the actual value. When the output signal from generator 4 is conducted through amplifier 12 to divider 6, divider 6 modifies the output signal from computer 2 in a manner such that the signal then conducted to turbine master 8 again corresponds to a valve point. Satisfaction of the indicated load demand is then effected by control of the boiler output pressure.

Rate limiter 10 simply acts, as the name implies, to limit the rate at which the adjustment signal produced by generator 4 can vary the signal supplied to turbine master 8.

All of the components described thus far find their counterpart in the above-cited U.S. Pat. No. 4,178,762, particular reference being made to FIGS. 7–10 of that patent in which the box labeled "LOAD DEMAND COMPUTER OR PLANT MASTER" corresponds to the load demand computer described herein, element 324 corresponds to divider 6, and unit 20 includes a turbine master (200 in FIG. 10 of the patent) and a governor valve controller. Unit 318 in FIG. 10 of the patent corresponds to function generator 4.

In known plants of this type, particularly older plants, the governor valves may not assume positions which correspond precisely to that indicated by the output signal from turbine master 8, and this for a variety of reasons including wear experienced by the mechanical components of the governor valve controller or the effect of inherently inaccurate positioning mechanisms.

According to the present invention, such inaccuracies may be compensated by modifying the value of the signal supplied to turbine master 8 as a function of any difference which exists between the measured steam flow through the throttle valve and the expected steam flow which is a function of the boiler output pressure. To achieve this, the system according to the invention includes a turbine model 16, examples of which are in industrial use, connected to receive a signal derived from measurement of the boiler output, or throttle, pressure, which is the pressure at the inlet of the boiler throttle valve.

Basically, turbine model 16 is provided with data identifying the total flow area of the governor valve passages when all valves are open and the total flow area associated with the selected valve point, and the rated, or maximum allowable, boiler output pressure. The model combines this data with the measured boiler output pressure value to derive a representation of the expected steam flow rate. Mathematically, the expected steam flow rate is equal to the product of two terms: the ratio of the governor valve flow area associated with the selected valve point to the flow area when all governor valves are open; and the ratio of measured throttle pressure to rated throttle pressure. If the actual steam flow rate does not vary linearly with the second term, an empirically derived nonlinear function can be substituted for the second term.

The resulting expected steam flow rate representation is delivered by model 16, together with a signal on a line 18 derived from actual measurement of the steam flow rate, to a difference former 20 which produces an output signal representative of the difference between the measured steam flow rate and the expected steam flow rate. The expected steam flow rate corresponds to that which will occur when the governor valves are set to the appropriate valve point.

The output signal from difference former 20 is supplied to an integrator 24 having a long time constant and the output from integrator 24 is supplied to a second input of amplifier 12, which is here a summing amplifier integrator 24 controlled by a control signal on a line 30 supplied by the plant control system. The signal on line 30 determines whether correction for governor valve position errors is to be effected. If such correction is not to be effected, integrator 24 is turned off by the control signal on line 30 so that the signal at the output of integrator 24 is set to a value of zero. When a governor valve position error is to be corrected, the control signal on line 30 is given a value which turns integrator 24 on. Then, integrator 30 generates an output signal representing the time integral of the difference signal from difference former 20. When the difference indicated by the output signal from difference former 20 reaches zero, the output signal from integrator 24 assumes a fixed, stable value. The output signal from integrator 24 is supplied to summing amplifier 12, where it is added to the signal from rate limiter 10 to control the effective division ratio of divider 6.

The difference signal produced by difference former 20 is controlled to have a polarity which will cause the influence of the output signal from integrator 24 on the dividing ratio of divider 6 to adjust the positions of the governor valves in a direction to cause the measured steam flow rate to equal the expected steam flow rate, which positions correspond to the desired valve point for the governor valves.

Usually, integrator 24 is turned on only during sliding pressure operation. When the boiler output pressure is at its rated value, governor valve position correction will be performed by other elements of the plant control system.

Thus, the system according to the present invention does not require the addition of any components to directly monitor governor valve position; rather, the measured steam flow rate, which is a parameter that is measured in such a system in any event, serves as a substitute feedback signal that serves to effectively maintain the governor valves at the appropriate valve point.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a method for controlling the operation of a steam turbine system, which system includes a source of steam under pressure, means for varying pressure of the steam being produced by the source, a throttle valve connected to conduct steam from the source, a steam turbine having a first stage, a plurality of governor valves connected between the throttle valve and the turbine first stage, each governor valve being movable between two selected positions each creating minimum steam flow throttling losses, system control means for producing a system control signal representative of the desired power level to be supplied by the turbine system, and governor valve control means connected for producing a valve control signal in response to an input signal and for positioning each governor valve in accordance with the value of the valve control signal, which method includes giving the input signal to the governor valve control means a value which is based on the system control signal and which causes the valve control signal to have a value which will place each governor valve at least approximately at a selected position, the improvement wherein said method comprises: measuring the rate of flow of steam from the steam source; determining the difference between the measured rate of flow and the expected rate of flow of steam from the steam source; and modifying the value of the input signal to the governor valve control means in response to the difference determined in said determining step in a direction to vary the positions of the governor valves in a manner to reduce the magnitude of that difference.

2. A method as defined in claim 1 further comprising mathematically deriving a representation of the expected rate of flow of steam from the steam source as a function of the actual pressure of the steam being produced by the steam source and the desired positions of the governor valves, and employing the derived representation in said determining step.

3. A method as defined in claim 2 wherein said step of determining the difference comprises forming a representation of the time integral of the instantaneous difference between the measured and expected flow rates.

4. A method as defined in claim 3 wherein said step of forming a representation comprises mathematical integration of the instantaneous difference with a long time constant.

5. In apparatus for controlling the operation of a steam turbine system, which system includes a source of steam under pressure, means for varying pressure of the steam being produced by the source, a throttle valve connected to conduct steam from the source, a steam turbine having a first stage, a plurality of governor valves connected between the throttle valve and the turbine first stage, each governor valve being movable between two selected positions each creating minimum steam flow throttling losses, system control means for producing a system control signal representative of the desired power level to be supplied by the turbine system, and governor valve control means connected for producing a valve control signal in response to an input signal and for positioning each governor valve in accordance with the value of the valve control signal, the apparatus including means for giving the input signal to the governor valve control means a value which is based on the system control signal and which causes the valve control signal to have a value which will place each governor valve at least approximately at a selected position, the improvement wherein said apparatus further comprises: means for providing a signal representing the measured rate of flow of steam from the steam source; means connected for determining the difference between the measured rate of flow and the expected rate of flow of steam from the steam source; and means connected for modifying the value of the input signal to the governor valve control means in response to the difference determined by said means for determining in a direction to vary the positions of the governor valves in a manner to reduce the magnitude of that difference.

6. Apparatus as defined in claim 5 further comprising means for mathematically deriving a representation of the expected rate of flow of steam from the steam source as a function of the actual pressure of the steam being produced by the steam source .and the desired positions of the governor valves, the derived representation being supplied to said means for determining.

7. Apparatus as defined in claim 6 wherein said means for determining the difference comprises means for forming a representation of the time integral of the instantaneous difference between the measured and expected flow rates.

8. Apparatus as defined in claim 7 wherein said means for forming a representation comprises means for effecting a mathematical integration of the instantaneous difference with a long time constant.

* * * * *